United States Patent [19]

Wiard

[11] Patent Number: 4,741,320

[45] Date of Patent: May 3, 1988

[54] ARCHERY TRAINING AID

[76] Inventor: Arthur R. Wiard, 11694 Monsbrook Ct., Sterling Heights, Mich. 48077

[21] Appl. No.: 839,376

[22] Filed: Mar. 14, 1986

[51] Int. Cl.[4] ..... F41B 5/00

[52] U.S. Cl. ..... 124/24 R; 124/88; 124/DIG. 1

[58] Field of Search ..... 124/23 R, 24 R, 88, 124/90

[56] References Cited

U.S. PATENT DOCUMENTS

| | | | |
|---|---|---|---|
| 4,452,222 | 6/1984 | Quartino et al. | 124/24 R |
| 4,542,732 | 9/1985 | Troncoso | 124/24 R |
| 4,572,153 | 2/1986 | MacPherson | 124/88 |
| 4,612,906 | 9/1986 | Troncoso | 124/24 R |

*Primary Examiner*—Richard C. Pinkham
*Assistant Examiner*—Benjamin Layno

[57] ABSTRACT

An archery training aid comprising an indicator light, source of energy for the indicator light and a switch or contact device to sense the full draw of the bow. The contact device or switch in one embodiment comprises a slide block engaging the cable guard and retained thereagainst by two oppositely movable bow string flights. Electric contacts on the slide block are engageable by a metallic swage affixed to one of the flights at a location on the flight for movement into engagement with the slide block upon full draw of the bow. In the other embodiment the slide block is affixed to one of the flights and the swage affixed to the other oppositely directed flight. The slide block includes a slideable engagement with the other oppositely directed flight to retain alignment with the metallic swage. The indicator light is positioned conveniently adjacent the sight pin for simultaneous viewing by the archer. The archery training aid increases accuracy by providing visual indication the instant full draw is accomplished and whether or not full draw is maintained before release. The aid also psychologically allows the archer to calmly hold steady on target until the aid gives visual indication to release at full draw, thus reducing the maladies known in the sport as "target panic" or "freezing".

6 Claims, 2 Drawing Sheets

ARCHERY TRAINING AID

BACKGROUND OF THE INVENTION

The field of the invention pertains to compound bows for archery and, in particular, to devices for improving the competitive accuracy of the bow and archer by improving the repeatability of the draw of the arrow.

Arrow actuated means to signal to the archer that the arrow is sufficiently drawn are disclosed in several U.S. patents. U.S. Pat. No. 3,450,122 discloses a magnetic circuit through an electric switch. The magnetic circuit is closed by magnetically permeable material on the arrow to thereby close the electric switch and illuminate a light adjacent the sight. The device requires special arrows having a magnetic material adjacent the arrow tip and located for the proper draw of the arrow.

In U.S. Pat. No. 3,867,920 an electrical conductor at the proper location adjacent the arrow tip for proper draw completes an electric circuit through contacts in the arrow rest of the bow. With contact an electric signal light mounted on the bow illuminates.

U.S. Pat. No. 4,134,383 discloses a bow drawing indicator comprising a spring arm and electrical contacts mounted on the bow and actuatable to illuminate one or both of a pair of signal lights. The spring arm is attached to a connector cord in turn attached to a pass of the bow string. A specially constructed arrow is not required to actuate the signal lights.

In U.S. Pat. No. 4,179,613 a photoelectric sensor is used to signal the full draw of the arrow by sensing the tip of the arrow. Sensing the arrow tip causes a signal light on the bow to illuminate.

U.S. Pat. No. 4,421,093 discloses a pair of draw stop members each connected to a cable pass or flight that moves opposite the other. The draw string is pulled back until the draw stop members abut one another signalling manually to the archer that the draw string has been pulled to the desired length. However, there is no indicator light or sound to tell the archer the instant he is at full draw, or whether the draw is being maintained.

In addition, devices are available that produce an audible click upon full draw of the arrow, however, such devices cannot be reset without fully releasing the arrow from the bow.

With a view towards simplifying the electrical devices of the prior art and obtaining better repeatability of shooting form and the subsequent improvement in accuracy, applicant has invented the archery training aids disclosed and claimed below.

SUMMARY OF THE INVENTION

The archery training aid comprises a light source such as a light emitting diode mounted on the bow conveniently adjacent the sight pin, a source of electric energy such as a battery and switch or contact means to sense a proper full draw of the draw string and arrow. In one of the preferred embodiments a cable guard slide block for two of the cable passes or flights includes contact points for engagement with a conductive swage on one of the passes. In another embodiment, where the cable guard is not used or absent, a contact block affixed to one of the passes engages a conductive swage on the other adjacent oppositely movable pass.

The training aid acts as an extremely accurate and repeatable draw length determinant by instantly indicating that the archer has reached full draw and indicating that the archer is retaining a full draw. If the archer relaxes slightly or creeps, the light source or indicator light, conveniently in view adjacent the sight pin, is instantly extinguished. Thus, the archer need not release the arrow immediately and is assured of constant repeatable shooting form.

The training aid is not dependent upon specially modified arrows or devices adjacent the arrow rest actuated by the arrow. The training aid is equally useful for target shooting or field hunting with multi-bladed arrows.

The training aid gives a visual indication of full draw rather than a sudden sound. The archer can be confident the bow is at full draw while taking some additional time before releasing the arrow, which is not possible with the mechanical clickers of the prior art. The archer can release the arrow any time he feels confident he is on target. Target "panic" or "freezing" is remedied by the continuous signal of full draw for a smoother release and proper follow-through

DESCRIPTION OF THE PREFERRED EMBODIMENT

Figure 1:
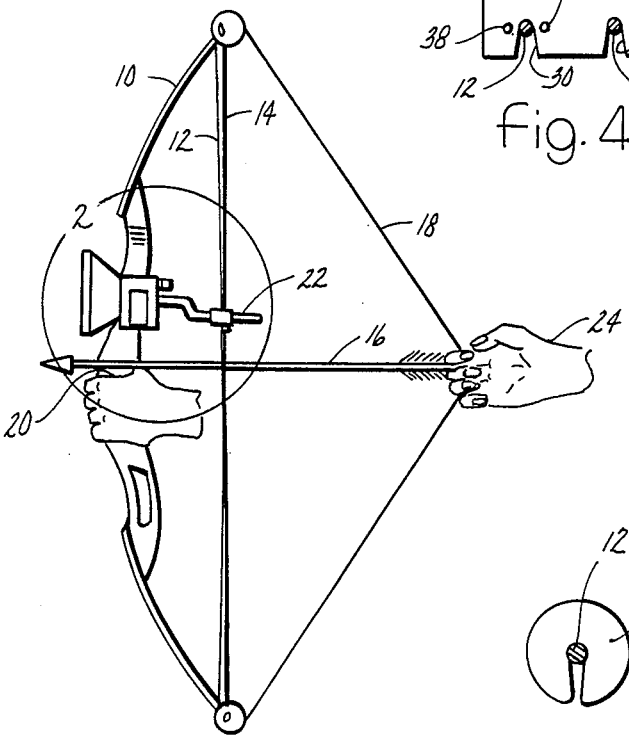
FIG. 1 is a side view of the drawn bow and arrow.

Illustrated in FIG. 1 is a compound bow 10 having at least two flights of cable 12 and 14 movable relative to the bow upon draw of the arrow 16 with the arrow flight 18 of the cable.

Attached to the bow 10 above the arrow rest 20 is a cable guard 22 which extends rearwardly toward the archer 24. The cable guard 22 prevents the bow string flights 12 and 14 from interfering with the release of the arrow 16.

Figure 2:
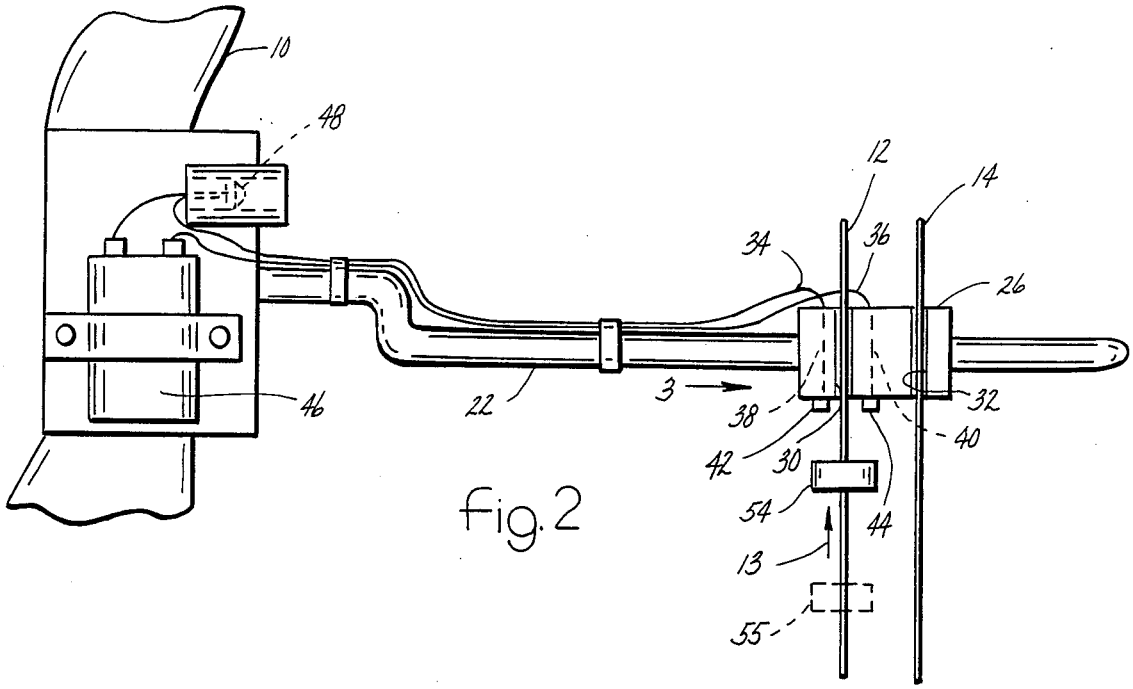
FIG. 2 is an enlarged side view detail of a cable guard and slide block on the bow of FIG. 1.
Figure 4:
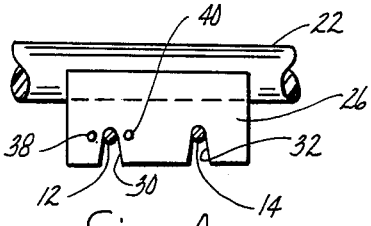
FIG. 4 is a top view of the slide block of FIG. 3.
Figure 3:
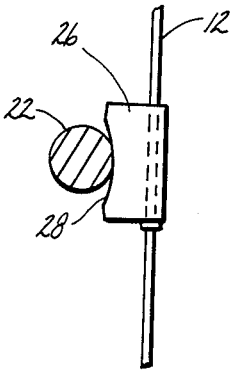
FIG. 3 is a detail view of the slide block taken in the direction of arrow 3 in FIG. 2.

Illustrated in FIGS. 2, 3 and 4 is a slide block 26 having a slightly concave side 28 adapted to engage the cable guard 22. On the other side of the slide block 26 are a pair of grooves or channels 30 and 32 adapted to slideably engage the bow string flights 12 and 14 respectively. The tension in the cable flights 12 and 14 retains the slide block 26 in engagement with the cable guard 22, however, the slide block is free to move horizontally on the cable guard and the flights 12 and 14 are free to move vertically in the grooves 30 and 32.

A pair of electric wires 34 and 36 extend vertically through holes 38 and 40 respectively in the slide block 26. The wires are attached to metallic contacts 42 and 44 on the bottom of the slide block adjacent each side of channel 30. Attached to the bow is a small battery 46 and indicator light 48, the indicator light located for ease of viewing by the archer.

Figure 7:
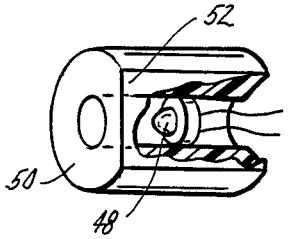
FIG. 7 is a cutaway perspective view of the light for the training aid.

As shown in FIG. 7 the indicator light 48 may be a light emitting diode mounted in a tube 50 having a flat side 52 for adhesive mounting on the bow or cable guard attachment.

Figure 5:
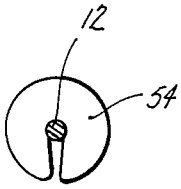
FIG. 5 is a top view of the conductive swage.
Figure 6:
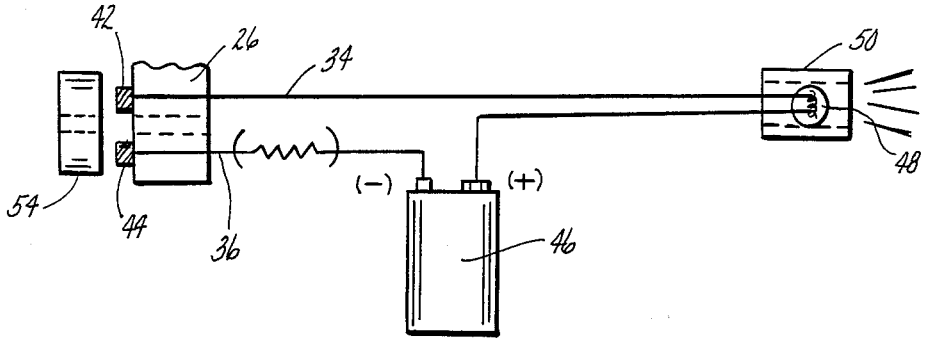
FIG. 6 is a schematic view of the electric circuit for the training aid.

Referring to FIGS. 2 and 5 a copper swage or similar device 54 is attached to the bow string flight 12 and moves therewith as indicated by dotted outline 55 and arrow 13 as a the bow is drawn. The swage 54 is located on the flight 12 such that the swage 54 contacts the metallic contacts 42 and 44 as the bow is fully drawn. The contact completes the electric circuit shown in FIG. 6 and causes the indicator light to illuminate thereby indicating that the arrow 16 is fully drawn.

Figure 8:
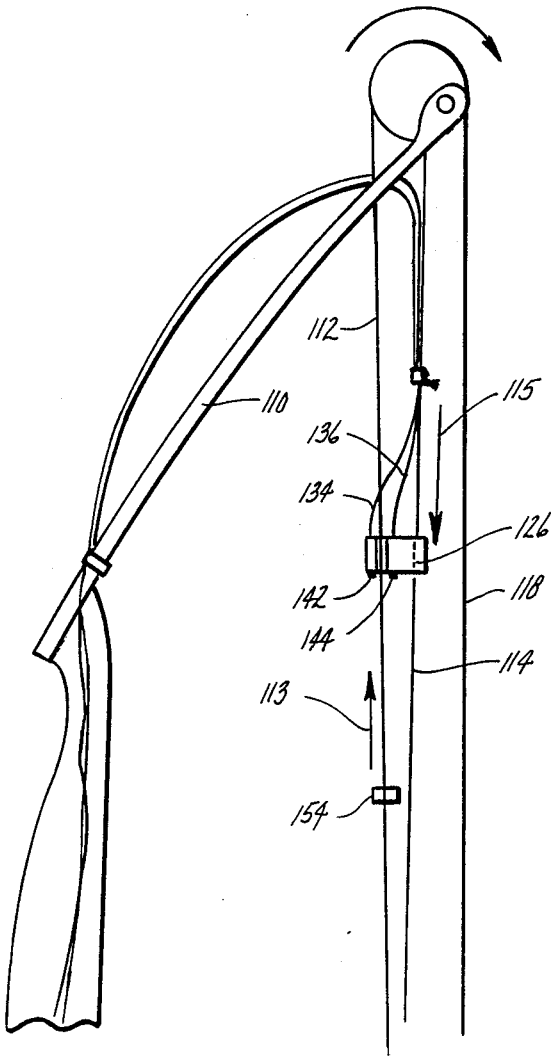
FIG. 8 illustrates in cutaway view an optional form of the slide block where the cable guard is absent.
Figure 9:
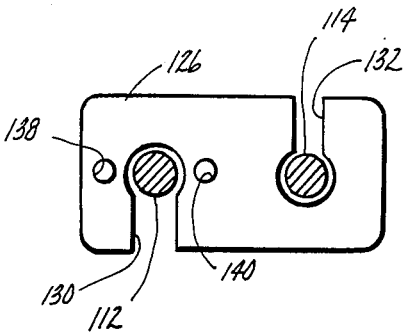
FIG. 9 is a top view of the slide block of FIG. 8.
Figure 10:
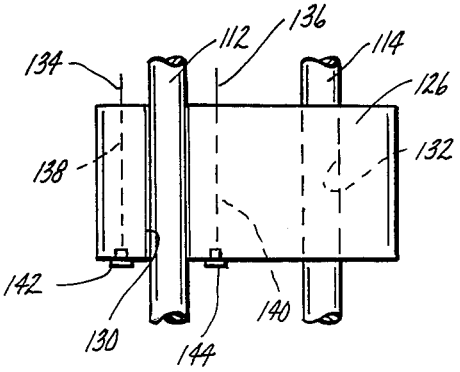
FIG. 10 is a detailed side view of the slide block of FIG. 8.

FIGS. 8, 9 and 10 illustrate an alternate embodiment of the slide block portion of the training aid for compound bows either not equipped with a cable guard or where the cable guard is not used as a guide way for the training aid. Bow 110 includes bow string flights 112 and 114 which move in opposite directions as indicated by the arrows 113 and 115 upon extension of the arrow flight 118. A copper swage 154 is affixed to flight 112 for movement therewith and engagement with a slide block 126 which simultaneously moves with flight 114 in the opposite direction.

The slide block 126 of the alternate embodiment includes a groove or channel 130 for sliding engagement with the flight 112. The second groove or channel 132, however, extends into the block from the opposite side as best shown in FIGS. 9 and 10 and is sized for a tight or interference fit on the flight 114. Both channels 130 and 132 are generally keyhole shaped as shown in FIG. 9 to retain the flights therein. Thus, the slide block 126 is clamped to and moves with the flight 114 in the direction 115 as the arrow flight 118 is drawn.

As above a pair of electrical contacts 142 and 144 are located adjacent either side of the groove or channel 130 and electric wires 134 and 136 extend through holes 138 and 140 in the slide block 126. The circuit is closed to illuminate the indicator light when the copper swage 154 on flight 112 contacts the pair of electric contacts 142 and 144.

For either embodiment the copper swage is located on the flight by drawing the arrow flight to full draw with the swage in engagement with the electric contacts and then crimping the swage to its flight.

I claim:

1. An archery training aid comprising an indicator light attachable to a bow conveniently within the archer's view, a source of electric energy for the indicator light, and means to connect the source of electric energy to the indicator light upon sufficient draw of the bow, said connection means comprising a slide block slideably engageable with a cable guard on the bow, said slide block contacting the cable guard on one side only, bow string engagement means on said slide block, said bow string engagement means slideably engageable with at least one movable flight of a bow string, said bow string flight retaining the slide block to the cable guard, and contact means attachable to a movable flight of a bow string, whereby upon sufficient draw of the bow said contact means engages the slide block and the source of electric energy is thereby connected to the indicator light.

2. The archery training aid of claim 1 wherein said slide block includes a pair of electric contact points thereon and the contact means includes an electric conductor simultaneously engageable with both contact points upon engagement of the contact means with the slide block.

3. The archery training aid of claim 1 wherein the slide block includes a pair of bow string engagement means and said contact means comprises a metallic swage.

4. In an archery bow comprising compound flights of bow string and a cable guard, the improvement comprising an indicator light, a source of electric energy for the indicator light, and means to connect the source of electric energy to the indicator light upon sufficient draw with the bow, said connection means comprising a slide block slideably engaging the cable guard, said slide block positioned on one side of the cable guard only, bow string engagement means on said slide block, said bow string engagement means slideably engageable with at least one movable flight, said bow string flight retaining the slide block to the cable guard, and contact means attachable to a movable flight whereby upon sufficient draw of the bow said contact means engages the slide block and the source of electric energy is thereby connected to the indicator light.

5. The archery bow of claim 4 including a pair of contact points on said slide block and wherein the contact means includes an electric conductor simultaneously engageable with both contact points upon engagement of the contact means with the slide block.

6. The archery bow of claim 4 wherein the slide block includes a pair of bow string engagement means in engagement with a pair of oppositely movable flights and said contact means comprises a metallic swage on one of the flights.

* * * * *